US005441427A

United States Patent [19]

Yamada

[11] Patent Number: 5,441,427

[45] Date of Patent: Aug. 15, 1995

[54] CONNECTOR HOUSING

[75] Inventor: Satoshi Yamada, Shizuoka, Japan

[73] Assignee: Yazaki Corporation, Tokyo, Japan

[21] Appl. No.: 205,633

[22] Filed: Mar. 4, 1994

[30] Foreign Application Priority Data

Mar. 8, 1993 [JP] Japan ..... 5-009446 U

[51] Int. Cl.[6] ..... H01R 13/506

[52] U.S. Cl. ..... 439/686; 439/752

[58] Field of Search ..... 439/752, 595, 656, 689

[56] References Cited

U.S. PATENT DOCUMENTS 5,069,639 12/1991 Kodama et al. ..... 439/752

FOREIGN PATENT DOCUMENTS 50-78982 7/1975 Japan .

4-12270 1/1992 Japan .

4-85577 7/1992 Japan .

*Primary Examiner*—Gary F. Paumen

*Attorney, Agent, or Firm*—Armstrong, Westerman, Hattori, McLeland & Naughton

[57] ABSTRACT

A connector housing having a rear holder mainly applied to board connectors to provide a connector housing which can be applied to the automatic insertion process of terminals whereby the connector housing is arranged such that the terminals which are inserted in the terminal receiving chambers of the housing are fixed all together by the rear holder and the partition is provided on the frame of the rear holder, the guide projections are provided in correspondence to each terminal receiving chamber on the partition, and the guide projections are fit in the grooves provided on the dividing wall of the terminal receiving chambers, thus allowing smooth insertion of terminals.

5 Claims, 5 Drawing Sheets

CONNECTOR HOUSING

BACKGROUND OF THE INVENTION

1. Field of the Invention:

The present invention relates to a connector housing which is used in electric circuits and mainly applied to board connectors.

2. Description of the Prior Art

Among conventional connector housings which are applied to board connectors, there is, for example, a connector housing (K), such as that shown in FIG. 6, Japanese Utility Model Laid-open No. 50-78982.

The connector housing (K) is composed of a housing (b) having terminal receiving chambers (a) arranged in two horizontal rows and a frame-shaped rear holder (c) which is fit to the housing (b), and is designed to fix a terminal (d), which is inserted in the terminal receiving chamber (a), in the housing (b) by a securing projection (e) provided on the inner wall of the rear holder (c), as shown in FIG. 7.

However, in the structure of the connector housing (K) above, a member for smoothing the insertion of the terminal was not provided on the terminal receiving chamber (a) and the rear holder (c). Therefore, insertion of the terminal (d) was obstructed in some cases due to an abutment of the terminal receiving chambers (a) against the dividing wall. Moreover, there have been problems such that, because of the low rigidity of the rear holder (c), the housing (b) comes off easily since the rear holder (c) is formed into a frame shape, and the holding power for the terminals (d) is insufficient.

It is therefore an object of the present invention to provide a connector housing which is suitable for the automatic terminal insertion process.

SUMMARY OF THE INVENTION

The present invention is devised by focusing on the above-mentioned problems. The smooth insertion of a terminal into a terminal receiving chamber is made possible. The mounting of a rear holder onto a housing is made securely and thus providing a high holding power.

To attain the above object, the present invention has a connector housing in which a plurality of terminal receiving chambers are disposed side by side, and terminals inserted in these terminal receiving chambers are secured simultaneously by a rear holder, wherein it is characterized in that a guide projection is provided in correspondence to each of the terminal receiving chambers on the frame of the rear holder, and a groove for engaging with the guide projection is formed on the dividing wall of the terminal receiving chambers.

Moreover, it is desirable that a partition be provided in correspondence to the arrangement of terminal receiving chambers on the frame of the rear holder and that a guide projection be provided in correspondence to each of the terminal receiving chambers on the partition.

According to the present invention, since a guide projection is provided in correspondence to the terminal receiving chambers of the housing on the frame of the rear holder, upon inserting a terminal in a terminal receiving chamber by fitting a part of the frame of the rear holder into the housing, the terminal is inserted along by the guide projection. Therefore, obstruction of insertion caused by the abutting of the terminal against the dividing wall of the terminal receiving chambers can be eliminated, and thereby smooth and secure insertion of a terminal into a terminal-receiving chamber is made possible. Adaptability to the automatic insertion process of electrical terminals is improved.

Moreover, for cooperation with a housing in which a plurality of terminal-receiving chambers are arranged in multiple horizontal rows, a partition is provided for dividing the arrangement stage of the terminal-receiving chambers on the frame of the rear holder, and a guide projection is provided on this partition in correspondence to the terminal-receiving chamber, thereby enabling the terminal to be smoothly inserted in each terminal-receiving chamber as well as improving the mounting thereof onto the housing and the holding power for the terminals since the rigidity of the rear holder is increased and thereby almost no deformation is occurred at the rear holder.

DETAILED DESCRIPTION OF THE PREFERRED EMBODIMENTS

Figure 1:
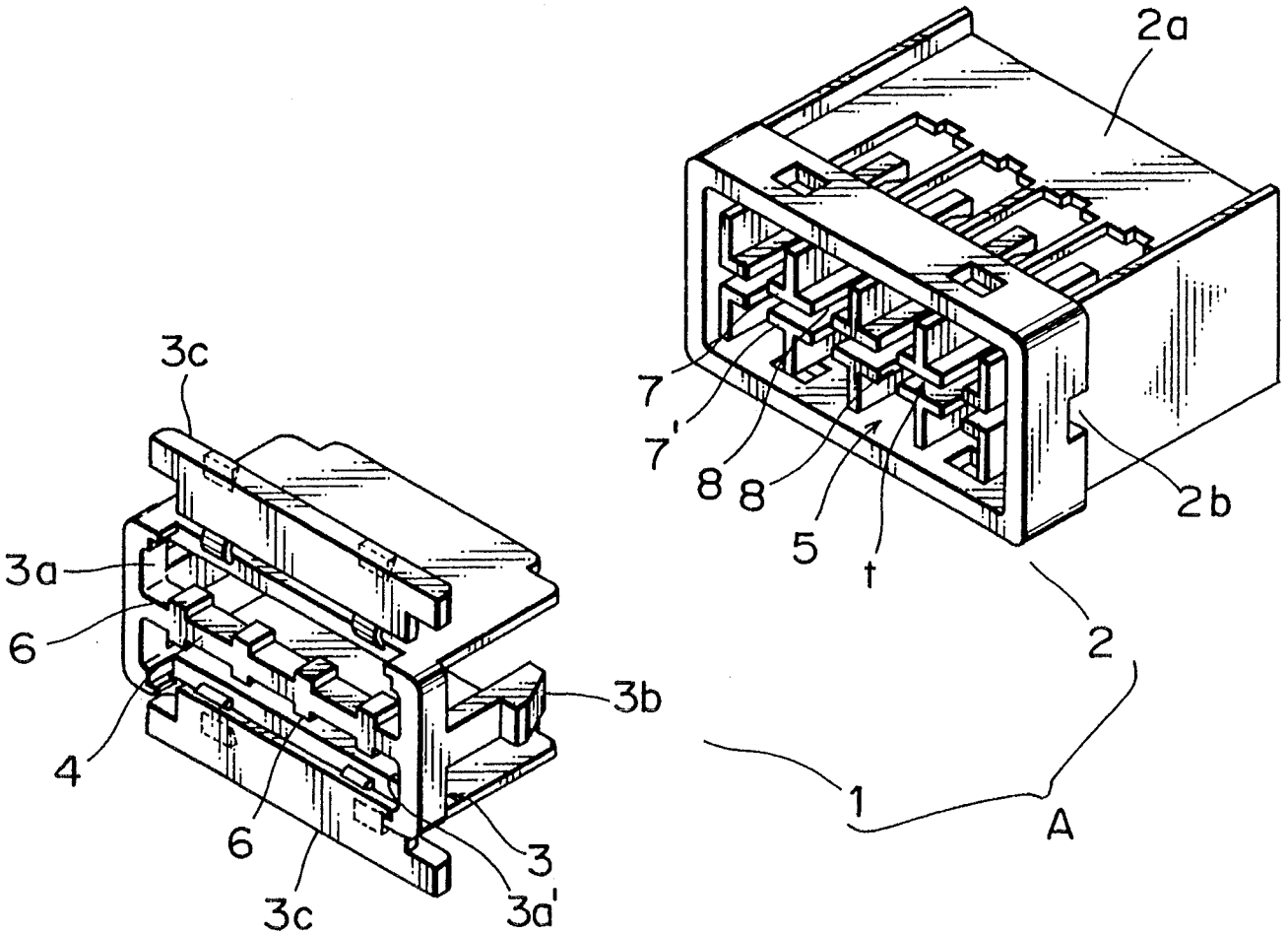
FIG. 1 is a perspective view illustrating the rear holder of a connector housing and a housing according to an embodiment of the present invention.

Now referring to FIG. 1, there is shown a perspective view illustrating a rear holder 1 and a housing 2 which constitute a connector housing A of an embodiment of the present invention.

The rear holder 1 is composed of a frame 3 which is formed by molding synthetic resin material. It has a structure in which a partition 4 is provided between side walls 3*a* and 3*a*′ facing to the frame 3, and the frame 3 is divided vertically into two sections.

Guide projections 6 are provided on both upper and lower sides of the partition 4 in correspondence to a terminal receiving chamber 5 of the housing 2.

A securing claw 3*b* is provided on the side wall 3*a*′ of the frame 3 to engage with an aperture 2*b* of the housing 2 for securing the rear holder 1 to the housing 2. An element 3*c* is a securing plate for securing the rear side of the terminals inserted in the terminal receiving chambers 5 when the rear holder 1 is fit and inserted into the housing 2.

In the housing 2, a plurality of terminal receiving chambers 5 are disposed in two horizontal rows within a box-shaped outer hull 2*a*. A dividing wall 7 of the upper terminal receiving chambers 5 and a dividing wall 7′ of the lower terminal receiving chambers 5 are separated from each other. A gap (t) is provided between them so that the partition 4 can be inserted. The dividing walls 7 and 7' are further provided with a groove 8 in which the guide projection 6 of the partition 4 is inserted.

Figure 2:
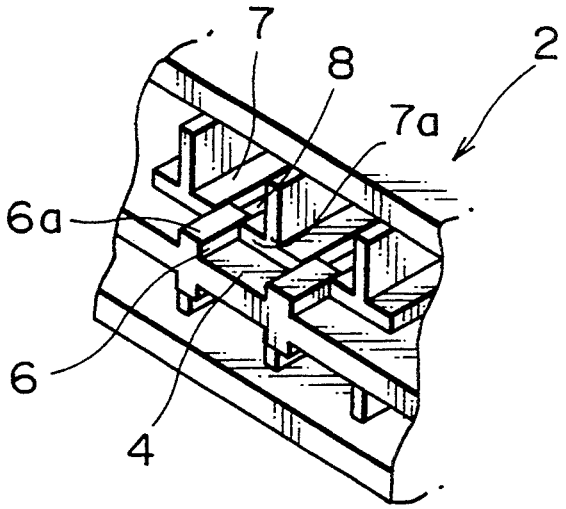
FIG. 2 is an explanatory diagram illustrating the state in which a rear holder is temporarily fixed on the housing of FIG. 1.
Figure 3:
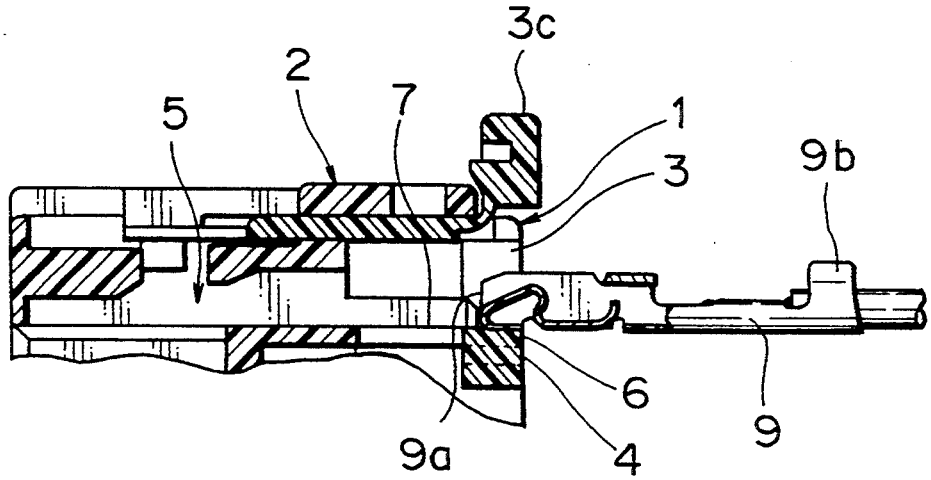
FIG. 3 is an explanatory diagram of the process in which a terminal is inserted in the terminal receiving chamber from the top of the partition of the rear holder of FIG. 2.

FIG. 2 is an explanatory diagram in which the rear holder 1 is temporarily fixed in the housing. It shows a state in which a part of the guide projection 6 of the partition 4 is fit in the groove 8 of the dividing wall 7, In this state, a part of the guide projection 6 of the partition 4 is fit in the groove 8 of the terminal receiving chamber 5. Since it is arranged such that the height of the top surface 6*a* of the guide projection 6 is substantially of equal to the thickness of the dividing wall 7, the terminal 9 can be inserted into the terminal receiving chamber 5 under such condition as the terminal 9 being in contact with the top of the guide projection 6, as shown in FIG. 3. Therefore, smooth insertion of the terminal can be implemented without abutting the head 9*a* of the terminal 9 against the forward end 7*a* of the dividing wall 7. Moreover, if an attempt were made improperly to insert the terminal upside down, the rear foot 9*b* of the terminal 9 may abut against the guide projection 6. Therefore, improper insertion can be prevented.

Figure 4:
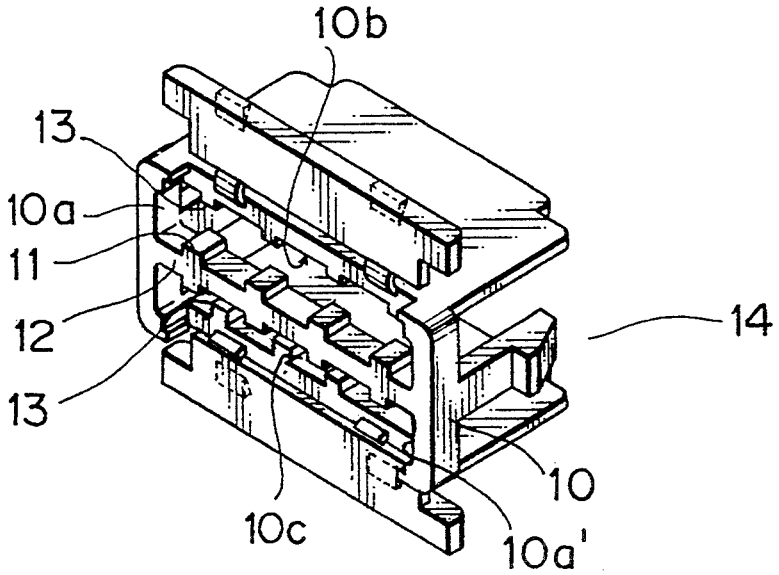
FIG. 4 is a perspective view of the rear holder according to another embodiment of the present invention.
Figure 5:
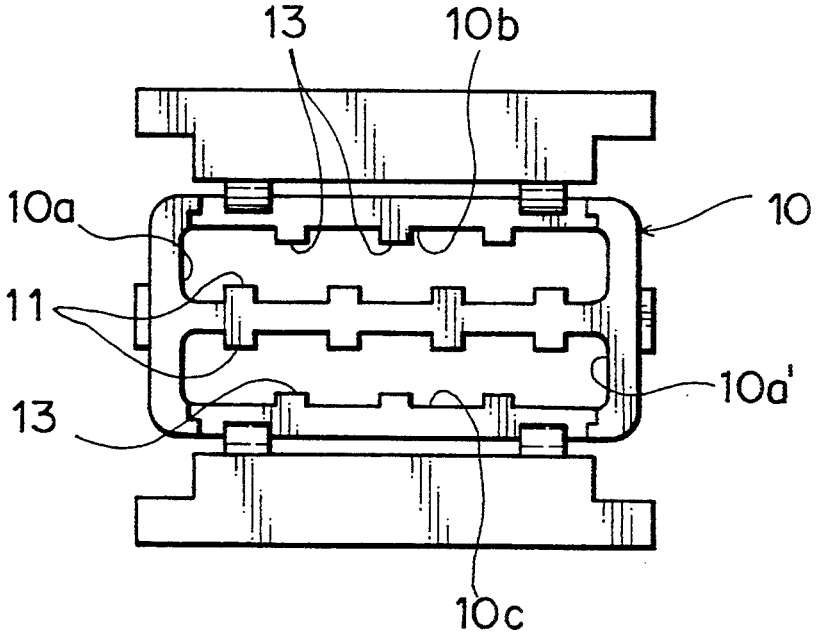
FIG. 5 is a front view of the rear holder in FIG. 4.
Figure 6:
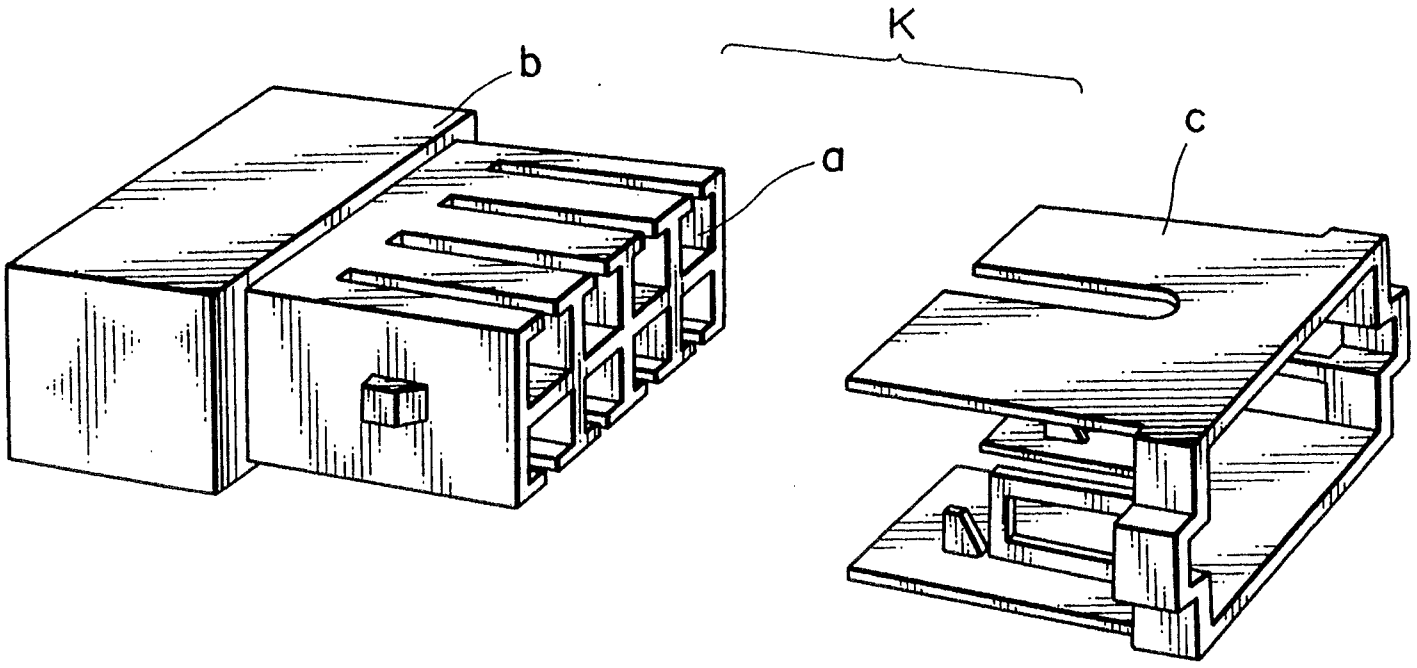
FIG. 6 PRIOR ART
FIG. 6 is a perspective view of the conventional connector housing.
Figure 7:
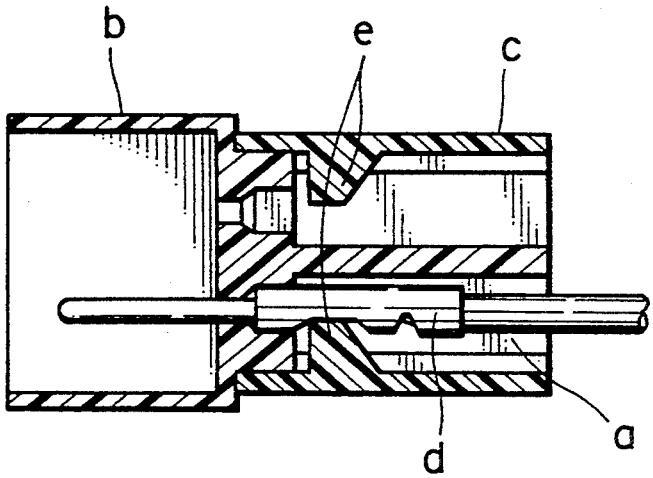
FIG. 7 PRIOR ART
FIG. 7 is a sectional view illustrating the state in which the terminal is inserted in the connector housing of FIG. 6.

FIG. 4 is a perspective view of the rear holder 14 relating to another embodiment of this invention. The rear holder 14 is mounted on the housing 2. A partition 12 having a guide projection 11 is provided between side walls 10*a* and 10*a'* of a frame 10, and projections 13 are provided in response to each terminal receiving chamber 5 of the housing 2 inside a bottom wall 10*c*. The projections 13 are provided at positions which are located alternately with respect to the guide projections 11 of the partition 12 as shown in FIG. 5.

Since the provision of the projection 13 is to prevent the terminals from inclined insertion, other than the above mentioned advantages of the rear holder 1 at the time of terminal insertion, the work efficiency of the terminal insertion can further be improved.

In the embodiment of the present invention above, the connector housing A in which the terminal receiving chambers 5 are arranged in two horizontal rows has been described, however, the terminal receiving chambers can also be arranged in three or more rows in a multiple-layer form within the connector housing, and a plurality of partitions can also be provided on the rear holder in accordance with the arrangement of the terminal receiving chambers.

Moreover, it can also be arranged such that, for a connector housing in which a plurality of terminal receiving chambers are merely provided in the lateral direction, the rear holder is not provided with a partition, and a guide projection similar to the guide projection 6 of the partition 4 is provided inside the frame of the rear holder to engage with the groove which is provided in the terminal receiving chamber.

Since, in the connector housing according to the present invention, a terminal is inserted along a guide projection provided in the frame of the rear holder, it is possible to provide easy and secure insertion of the terminal into the terminal receiving chamber, thus improving the adaptability to the automatic insertion process of the electric terminals.

Furthermore, for the housing in which a plurality of terminal receiving chambers are arranged in multiple rows and since a partition having a guide projection is provided on the frame of the rear holder, a terminal can be easily inserted in each terminal receiving chamber; the rigidity of the rear holder is strengthened; the mounting capability of the rear holder onto the housing is excellent; and the holding power of the terminal is improved. Therefore, the connector housing according to the present invention has such advantages that it is suitable for multipole connectors.

It is to be understood by those skilled in the art that the foregoing description relates only to a preferred embodiments of the present invention and that various changed and modifications may be made in the invention without departing from the spirit and scope thereof.

What is claimed is:

1. An electrical connector including:

a connector housing having a plurality of terminal receiving chambers, a rear holder, and terminals for disposition in said terminal receiving chambers, characterized by:

means in said connector housing forming a dividing wall means between adjacent terminal receiving chambers;

means forming a partition in said rear holder, said partition having a guide projection in correspondence with each of said terminal receiving chambers, and means on said dividing wall means forming a groove for reception of each of said guide projections.

2. The electrical connector as set forth in claim 1, wherein the plurality of said terminal receiving chambers are disposed in two rows, and said dividing wall means of the upper terminal receiving chambers and that of the lower terminal receiving chambers are separated from each other with a gap to receive the partition.

3. The electrical connector as set forth in claim 2, wherein said guide projections are provided on upper and lower sides of said partition in correspondence to each of the plurality of said terminal receiving chambers.

4. The electrical connector as set forth in claim 1, further comprising a securing claw provided on a side wall of the rear holder to be engaged with an aperture of the connector housing.

5. The electrical connector as set forth in claim 2, 3 or 1, wherein the height of the guide projections is substantially equal to a thickness of the dividing wall.

* * * * *